US006394517B1

(12) United States Patent
Borg

(10) Patent No.: US 6,394,517 B1
(45) Date of Patent: May 28, 2002

(54) SINGLE BOTTLE CARRIER

(75) Inventor: James C. Borg, Eugene, OR (US)

(73) Assignee: Oregon Precision Industries, Eugene, OR (US)

( * ) Notice: Subject to any disclaimer, the term of this patent is extended or adjusted under 35 U.S.C. 154(b) by 0 days.

(21) Appl. No.: 09/833,844

(22) Filed: Apr. 11, 2001

(51) Int. Cl.[7] ..... B65D 23/10
(52) U.S. Cl. ..... 294/31.2; 215/397
(58) Field of Search ..... 294/27.1, 31.2, 294/33, 87.2, 87.28, 137, 158, 166, 170, 171; 215/396, 397; 220/754, 758, 760; D9/434, 455

(56) References Cited

U.S. PATENT DOCUMENTS

| | | | | | |
|---|---|---|---|---|---|
| 2,759,756 | A | * | 8/1956 | Sikora | 294/31.2 |
| 3,275,366 | A | * | 9/1966 | Hidding | 294/31.2 |
| 3,311,252 | A | * | 3/1967 | Swartwood et al. | 294/31.2 X |
| 3,463,536 | A | * | 8/1969 | Updegraff et al. | 294/31.2 |
| 3,633,962 | A | | 1/1972 | Erickson | 294/87.2 |
| 4,090,729 | A | | 5/1978 | Erickson | 294/31.2 |
| 4,093,295 | A | | 6/1978 | Erickson | 294/87.2 |
| 4,235,468 | A | | 11/1980 | Erickson | 294/87.2 |
| 5,480,204 | A | * | 1/1996 | Erickson | 294/87.2 |
| RE35,288 | E | | 7/1996 | Borg | 294/87.2 |
| 5,806,904 | A | * | 9/1998 | Smith | 294/137 X |

FOREIGN PATENT DOCUMENTS

| | | | |
|---|---|---|---|
| GB | 2157257 | * 10/1985 | 294/31.2 |
| GB | 2230940 | * 11/1990 | 294/171 |
| WO | WO 94/02379 | 2/1994 | |

* cited by examiner

*Primary Examiner*—Johnny D. Cherry
(74) *Attorney, Agent, or Firm*—Chernoff, Vilhauer, McClung & Stenzel, LLP

(57) ABSTRACT

A bottle carrier for a single bottle including a substantially planar web of material, the web having an annular ring which includes a neck-engaging collar for selectively engaging the neck of a beverage bottle such as a juice bottle or milk jug. The carrier has a handle portion comprising a substantially U-shaped member having handle arms and a grip portion. The handle arms are joined to the annular ring on opposite sides thereof and the handle arms are sized and shaped so as to flex when the bottle is lifted by the handle portion after the neck has been engaged by the collar.

2 Claims, 2 Drawing Sheets

SINGLE BOTTLE CARRIER

BACKGROUND OF THE INVENTION

A gallon size polyethylene terephthalate ("PET") plastic bottle for juice or other beverage commonly has attached at its neck a separately molded bail type handle to aid the consumer in lifting the container and pouring the contents. These handles are manufactured from a flexible plastic, and are attached by means of a tightly fitting ring that fits into a recessed groove in the neck of the bottle. The high speed application of these handles to empty bottles requires expensive capital equipment and considerable physical space. Moreover, not all subsequent rinsing, filling, capping, and labeling equipment is compatible with the bottles having a handle already attached.

Other bottle carriers which may be affixed to plastic beverage bottles such as milk jugs are disclosed in U.S. Pat. No. RE 35,288 entitled "Carrier Strap for Bottles or Jugs" and in U.S. Pat. No. 5,346,271 entitled "Carrier for Containers." These carriers are most notably designed for multiple bottles or jugs. For example, the carrier shown in Borg, RE 35288, is designed to carry two bottles at a time.

Erickson, U.S. Pat. No. 4,090,729, describes a strap for carrying a single bottle by the neck within a split-ring opening within a frame member. Like other prior art devices, Erickson relies upon a substantially keyhole shaped split collar. Insertion and removal of a bottle is made by forcing open the annular portion of the collar. The bottle carriers are lifted by various means including finger openings in the top of the device or handles which are pivotable upwardly.

What is needed, therefore, is a comfortable, flexible, secure handle that can be applied at high rates with inexpensive equipment to containers that have already been filled, capped and labeled.

SUMMARY OF THE INVENTION

The present invention is a bottle carrier for a single bottle including a substantially planar web of material, the web having an annular ring which includes a neck-engaging collar for selectively engaging the neck of a beverage bottle such as a juice bottle or milk jug. The carrier has a handle portion comprising a substantially U-shaped member having handle arms and a grip portion. The handle arms are joined to the annular ring on opposite sides thereof and the handle arms are sized and shaped so as to flex when the bottle is lifted by the handle portion after the neck has been engaged by the collar.

The handle arms have a reinforcing inner rib that extends from the grip portion and tapers off substantially completely prior to an elbow at which each of the handle arms joins the annular ring. The material is thus thinned at the elbow where the arms join the ring thus permitting the handle to flex away from the plane of the web when the bottle is picked up by the handle. The reinforcing inner rib extends along the inside of the grip portion and may include scalloped edges adapted to fit the fingers of a user.

The neck-engaging collar may be frustoconically shaped so that it may be snapped down from the top over the neck of the bottle. The collars yields as the annular ring is pushed down over the neck. Since the cone of the collar points upward once the collar is engaged, it is resistant to slippage due to the weight of the bottle.

The foregoing and other. objectives, features, and advantages of the invention will be more readily understood upon consideration of the following detailed description of the invention, taken in conjunction with the accompanying drawings.

DETAILED DESCRIPTION OF THE INVENTION

Figure 1:
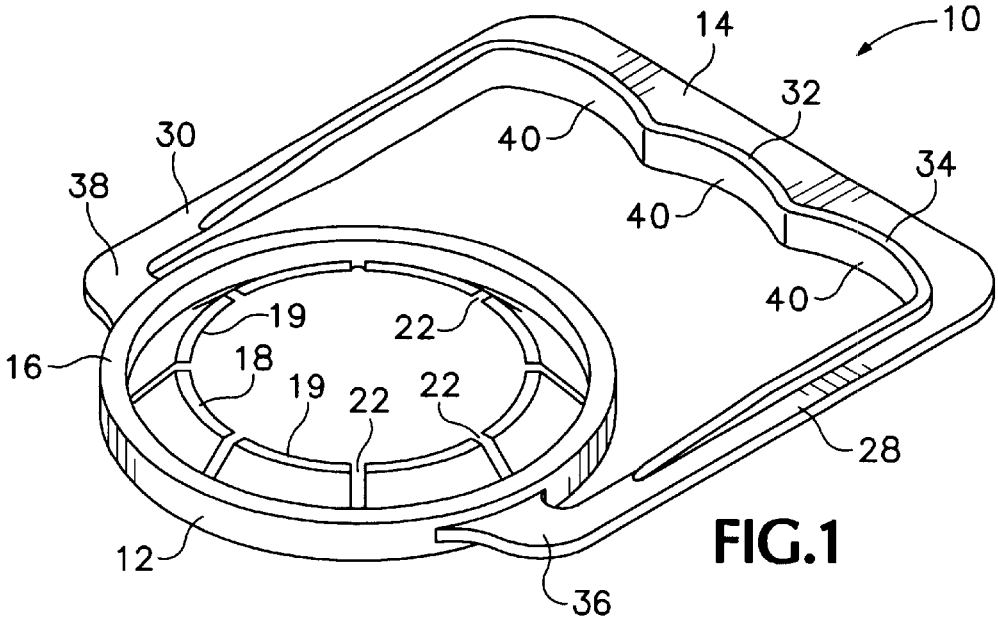
FIG. 1 is a single bottle carrier of the present invention lying flat prior to its attachment to a bottle.
Figure 2:
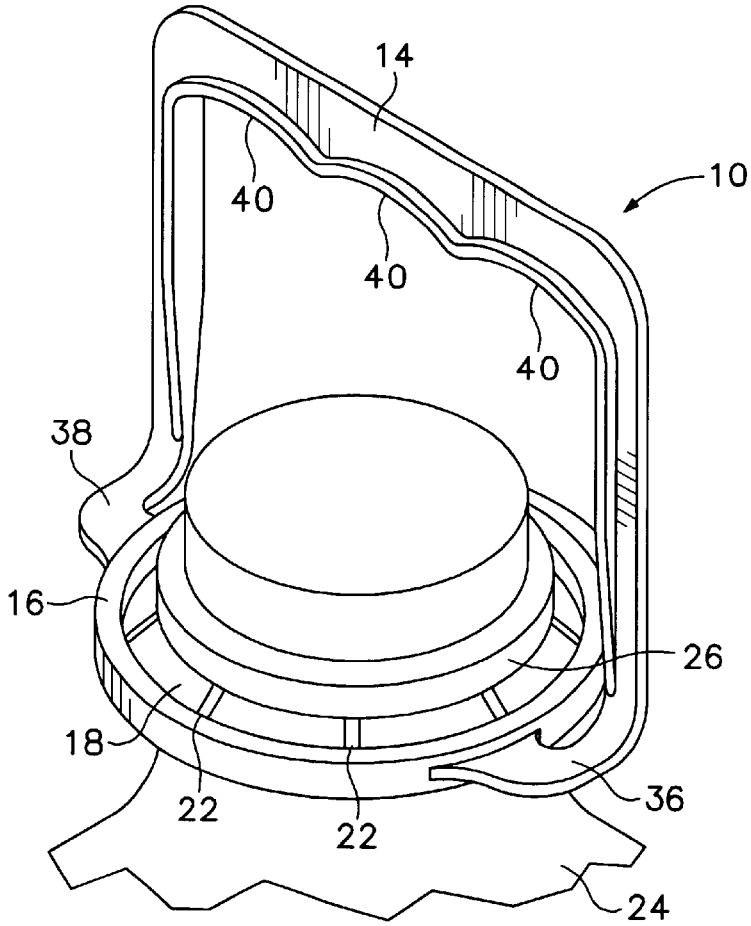
FIG. 2 is a perspective view of the bottle carrier of FIG. 1 attached to a bottle and having its weight supported by the hand of a user (not shown).
Figure 4:
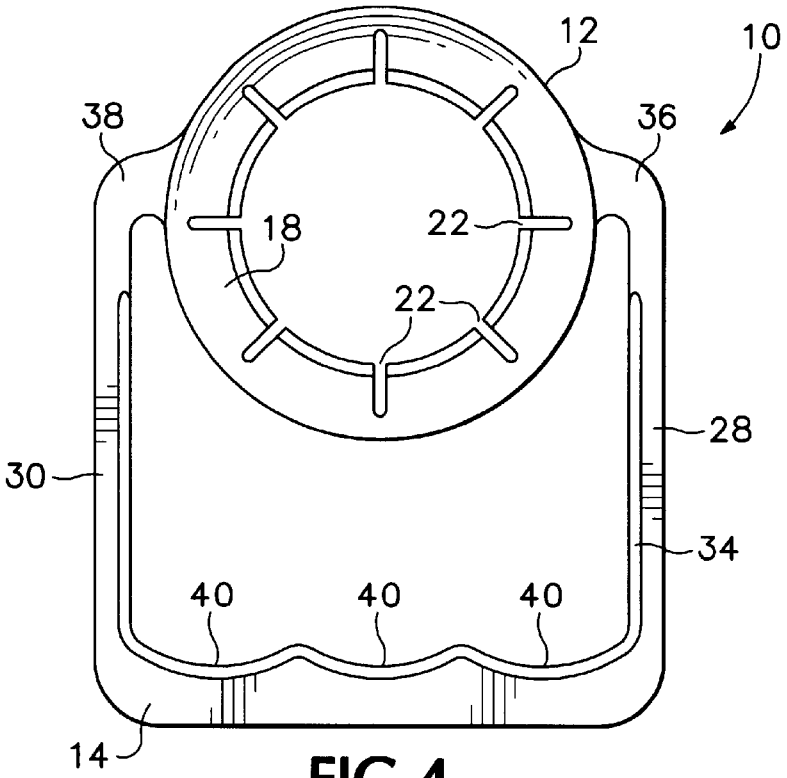
FIG. 4 is a bottom view of the bottle carrier of FIG. 1.
Figure 3:
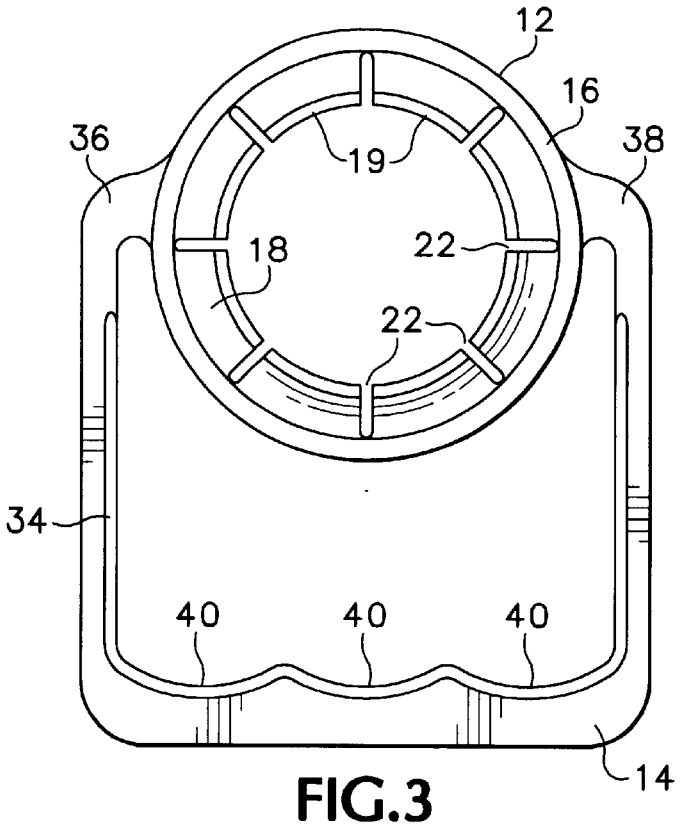
FIG. 3 is a top view of the bottle carrier of FIG. 1.
Figure 5:
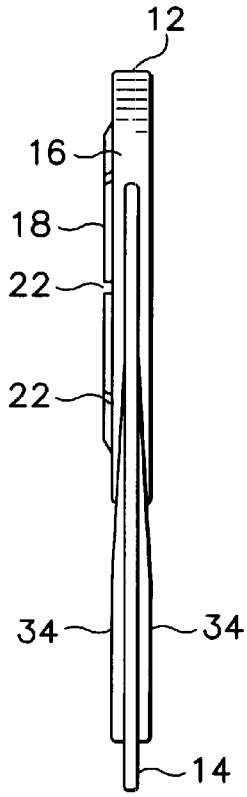
FIG. 5 is a side view of the bottle carrier of FIG. 1.

A single bottle carrier 10 includes a substantially planar web of material that in its normal state lies flat in what is essentially a horizontal plane. The bottle carrier 10 includes an annular ring portion 12 and a handle portion 14. The annular ring portion comprises a reinforced ring 16 supporting a neck-engaging collar 18. The ring 16 may have tabs 20*a* and 20*b* by which the bottle carrier may be pulled off of the neck of the bottle when it is no longer needed. The neck-engaging collar 18 includes slots 22 which permit the collar to flex as it is pushed down over the neck of the bottle. Most PET bottles, such as bottle 24 in FIG. 2, include a substantial annular flange such as flange 26. The slots 22 permit the collar to flex so that the collar can slip down over the flange 26 as the bottle holder is pushed onto the neck of the bottle 24 by processing machinery or the like. The shape of the neck-engaging collar 18 is frustoconical as best shown in FIG. 1, that is, the collar 18 is in the shape of a truncated cone inclined at an upward angle so that it flexes easily and snaps over the neck flange 26 of a typical bottle when pushed down over the neck of the bottle. In addition, the radially innermost portion of the collar 18 has a flattened flange portion 19 which snugly engages the underside of the bottle neck flange 26. The conical slant of the collar 18 provides an upward force component which resists the weight of the bottle as it is being carried so that the bottle does not simply slip through the collar 18 when it is lifted by the handle 14.

The handle portion 14 includes a pair of arms 28 and 30 that extend from the ring 16 on opposite sides thereof. The generally U-shaped handle portion 14 also includes a grip portion 32 which spans the width of the bottle carrier between the arms 30 and 28.

A reinforcing rib 34 extends along the inside of the entire handle portion 14 from the grip portion but tapers off and stops at elbows 36, 38 on either side of the ring 16 where the ring is joined by the arm sections 28 and 30. The lack of reinforcement in the web material at elbows 36 and 38 allows the web material to flex at this point when the bottle is picked up by a user where the holder is supporting the weight of the bottle.

In order to facilitate ease of gripping the bottle holder, the reinforcing rib includes scalloped inner edges 40 which are dimensioned to fit the fingers of a user's hand.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A bottle carrier for carrying a bottle by its neck, said bottle having a neck flange, comprising a substantially planar web of material, said web having an annular ring including a neck-engaging collar for selectively engaging the neck flange of said bottle, and a handle portion, said handle portion comprising a substantially U-shaped member having handle arms extending from opposite sides of said ring and a grip portion joining the handle arms, the handle arms being sized and shaped so as to flex when said bottle is lifted by the handle portion, the neck-engaging collar having a frustoconical shape with a flattened innermost radial flange portion for engaging the neck flange of said bottle.

2. The single bottle carrier of claim 1 wherein said neck-engaging collar includes a plurality of radial slots for permitting said collar to flex as said collar is pushed downwardly over said neck flange of said bottle.

* * * * *